US008641308B2

(12) United States Patent
Peyton et al.

(10) Patent No.: US 8,641,308 B2
(45) Date of Patent: Feb. 4, 2014

(54) BALL POINT PEN

(76) Inventors: Jerry F. Peyton, Oro Valley, AZ (US); Georgia C. Peyton, Oro Valley, AZ (US)

( * ) Notice: Subject to any disclaimer, the term of this patent is extended or adjusted under 35 U.S.C. 154(b) by 0 days.

(21) Appl. No.: 13/461,448

(22) Filed: May 1, 2012

(65) Prior Publication Data

US 2013/0294812 A1 Nov. 7, 2013

(51) Int. Cl.
*B43K 7/12* (2006.01)

(52) U.S. Cl.
USPC ..... 401/117; 401/116; 401/6; 401/107

(58) Field of Classification Search
USPC ..... 401/107, 108, 116, 117, 6
See application file for complete search history.

(56) References Cited

U.S. PATENT DOCUMENTS

| | | | | |
|---|---|---|---|---|
| 2,435,185 | A * | 1/1948 | Reynolds | 401/117 |
| 2,941,511 | A * | 6/1960 | Cieremans | 401/116 |
| 3,740,159 | A * | 6/1973 | Smagala-Romanoff | 401/117 |
| 4,580,919 | A | 4/1986 | Ambasz | |
| 4,679,954 | A | 7/1987 | Ambasz | |
| D321,718 | S | 11/1991 | Ambasz | |
| 6,830,402 | B2 | 12/2004 | Sunatori | |

* cited by examiner

*Primary Examiner* — David Walczak

(57) ABSTRACT

A ballpoint pen system has a pen housing, a top cap, and a ballpoint ink cartridge located in the pen housing. The top cap is located on a pen housing anterior end. In a first closed position a top cap anterior internal annular ridge and a top cap posterior internal annular ridge engage an anterior annular groove and a median annular groove of the pen housing, respectively. In a second, open position, the top cap anterior internal annular ridge and the top cap posterior internal annular ridge engage the median annular groove and a posterior annular groove of the pen housing, respectively. In a first position, the ballpoint tip is located below a top cap anterior end aperture. In a second position, the ballpoint tip is located above and through the top cap anterior end aperture.

4 Claims, 7 Drawing Sheets

BALL POINT PEN

BACKGROUND OF THE INVENTION

The ever popular ballpoint pen has been in use since the late 1800s having representations of the modern version dating to the 1940s. Ballpoint pens typically consist of a writing instrument with an internal ink reservoir that dispenses ink from a tip having a roller ball. In the beginning, the ballpoint pen was developed as a fine writing utensil, but through the years a branch of ballpoint pens have been developed into inexpensive, yet versatile disposable pens mostly made of plastic. A primary advantage inherent to the ballpoint pen design, besides the low cost, includes a resistance to ink leakage. The present invention teaches a novel, yet inexpensive ballpoint pen system that is easy to use.

SUMMARY

The present invention features a ballpoint pen system. In some embodiments, the ballpoint pen system comprises a pen housing, a top cap, and a ballpoint ink cartridge located in the pen housing. In some embodiments, the top cap is located on a pen housing anterior end. In some embodiments, in a first closed position a top cap anterior internal annular ridge and a top cap posterior internal annular ridge engage an anterior annular groove and a median annular groove of the pen housing, respectively. In some embodiments, in a second, open position, the top cap anterior internal annular ridge and the top cap posterior internal annular ridge engage the median annular groove and a posterior annular groove of the pen housing, respectively.

In some embodiments, in a first position, the ballpoint tip is located below a top cap anterior end aperture. In some embodiments, in a second position, upon movement of the top cap in a downward manner toward the pen housing posterior end, the ballpoint tip is located above and through the top cap anterior end aperture.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
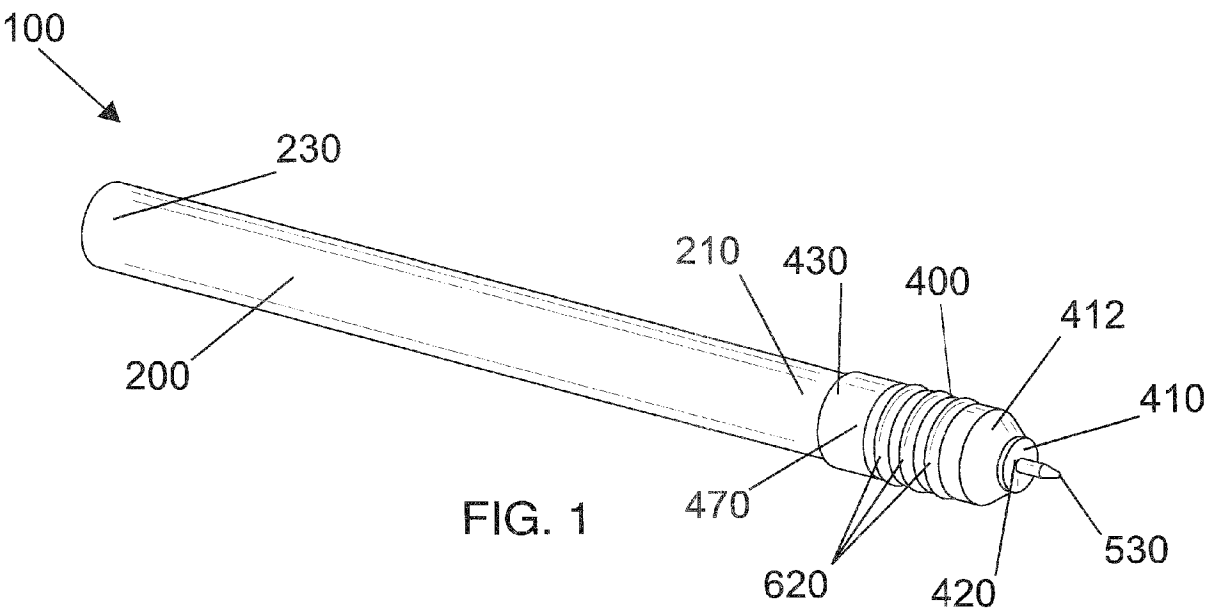
FIG. 1 is a perspective view of the present invention.
Figure 2:
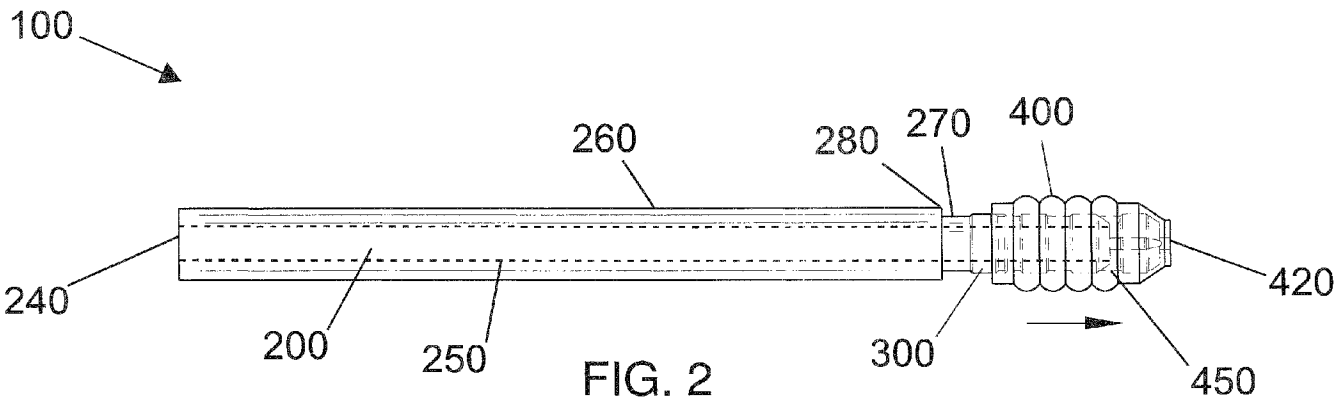
FIG. 2 is a side view of the present invention.
Figure 3:
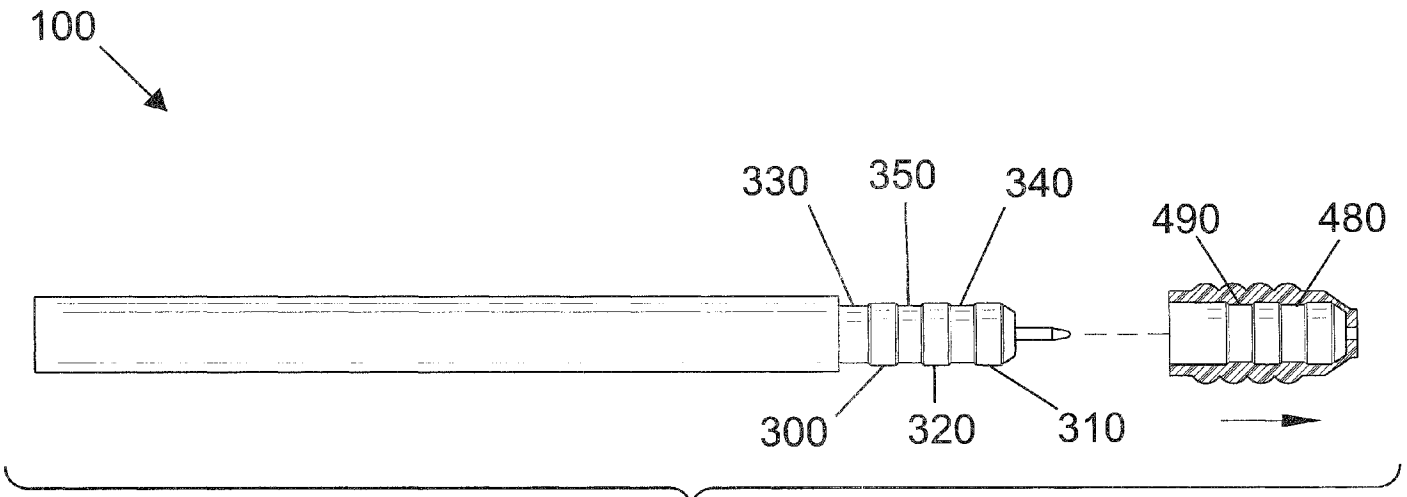
FIG. 3 is a side view of the present invention.
Figure 4:
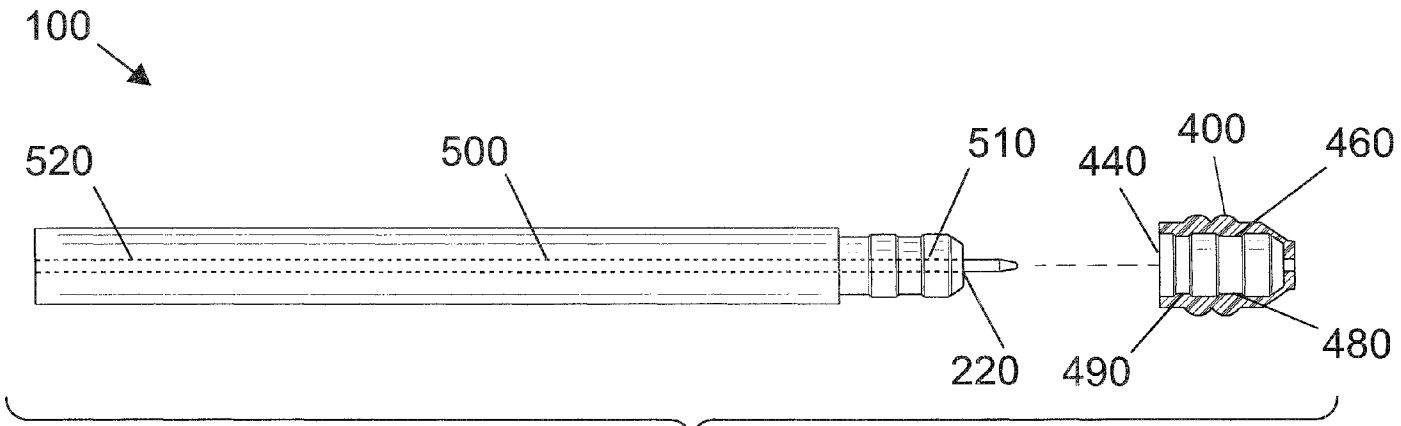
FIG. 4 is a side view of an alternate embodiment of the present invention.
Figure 5:
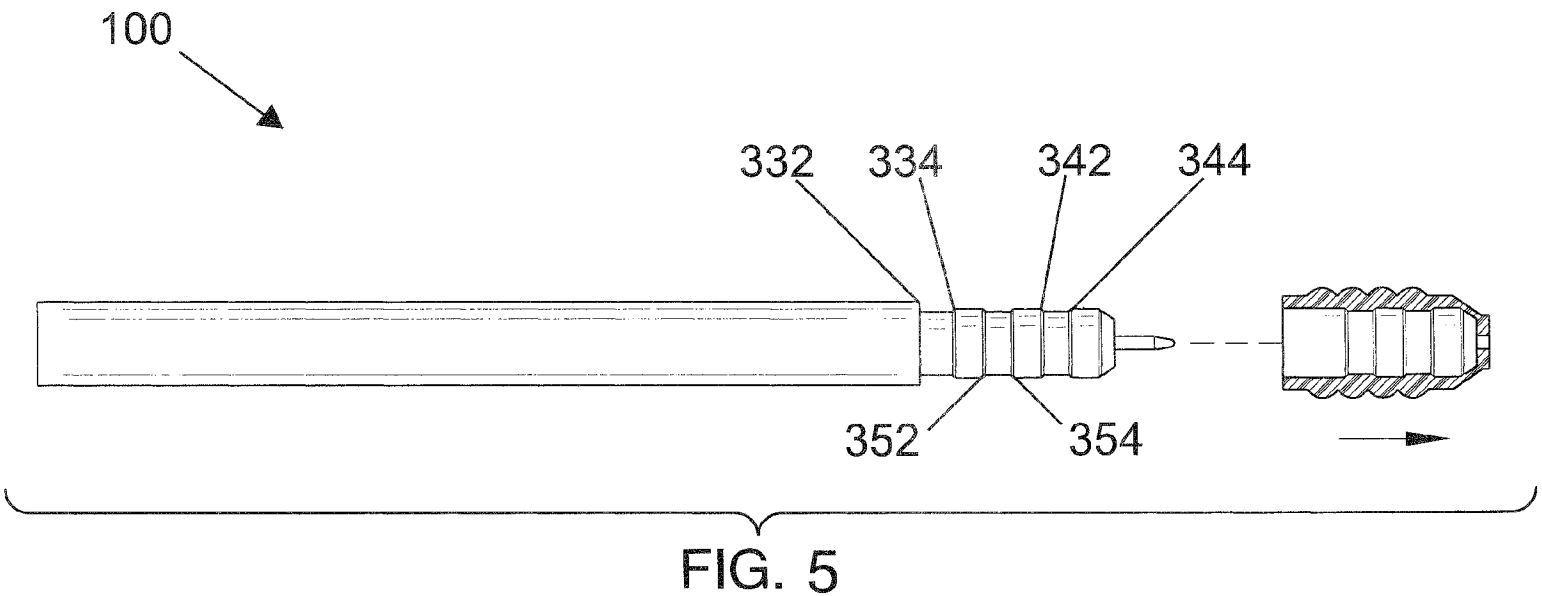
FIG. 5 is a side view of the present invention.
Figure 6:
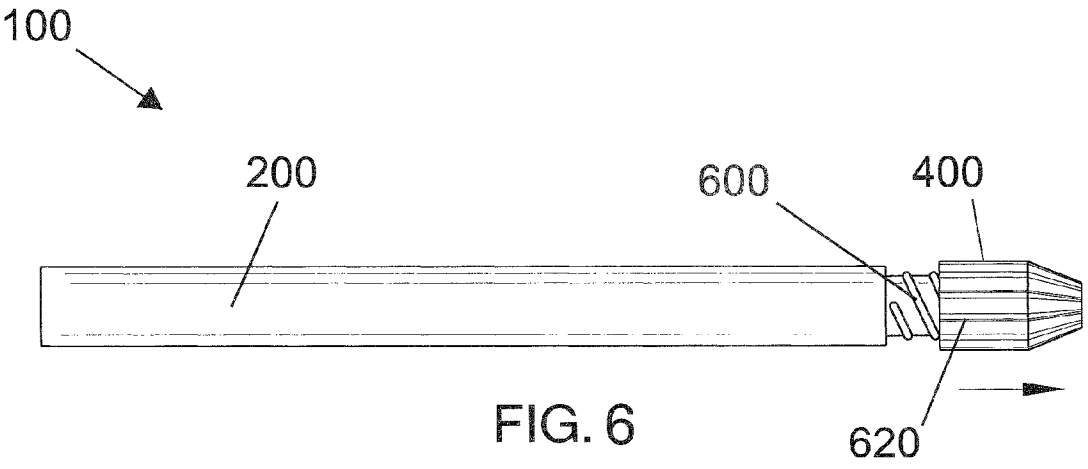
FIG. 6 is a side view of an alternate embodiment of the present invention.
Figure 7:
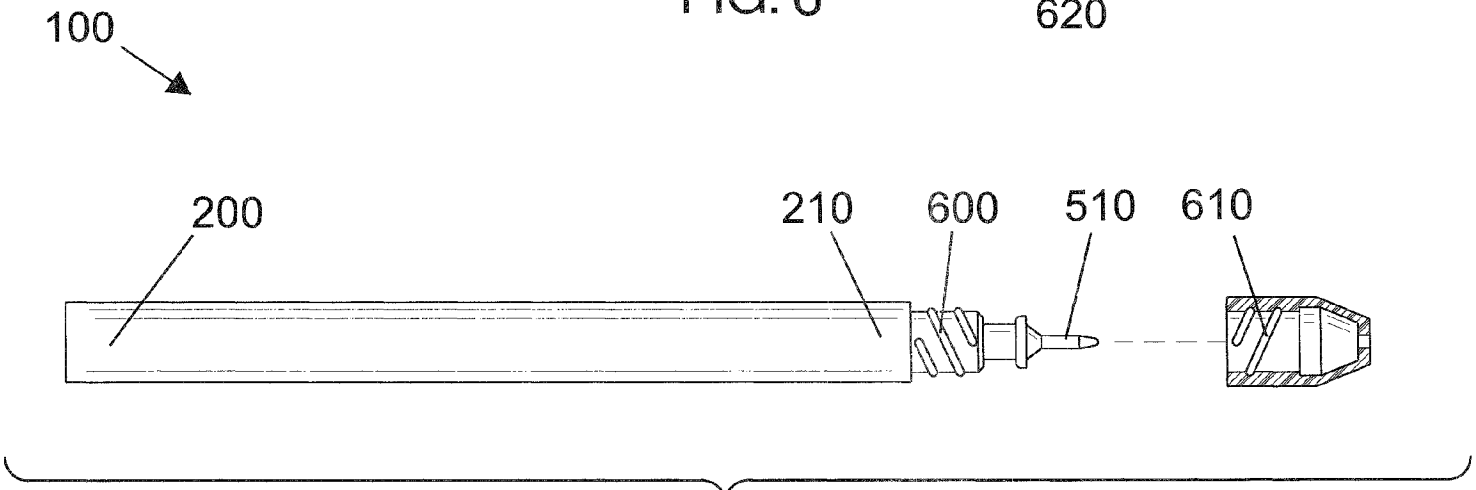
FIG. 7 is a side view of an alternate embodiment of the present invention.
Figure 8:
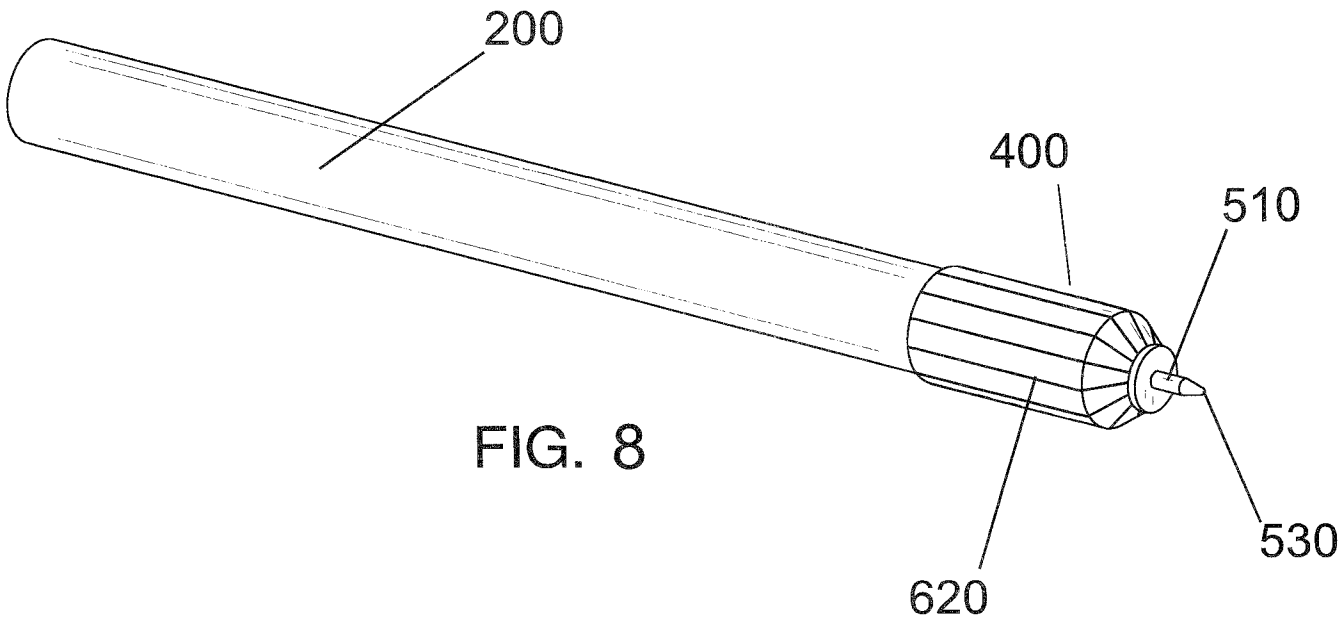
FIG. 8 is a perspective view of an alternate embodiment of the present invention.
Figure 9:
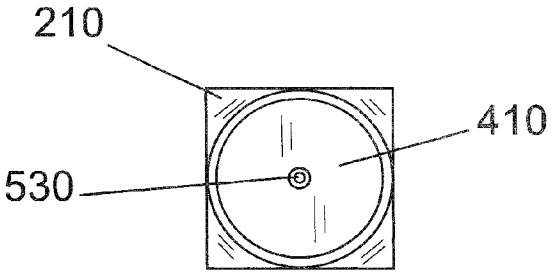
FIG. 9 is a front view of an alternate embodiment of the present invention.
Figure 10:
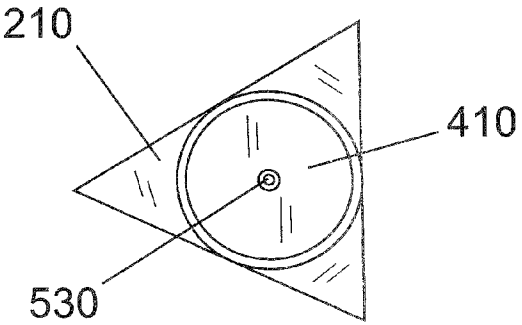
FIG. 10 is a front view of an alternate embodiment of the present invention.
Figure 11:
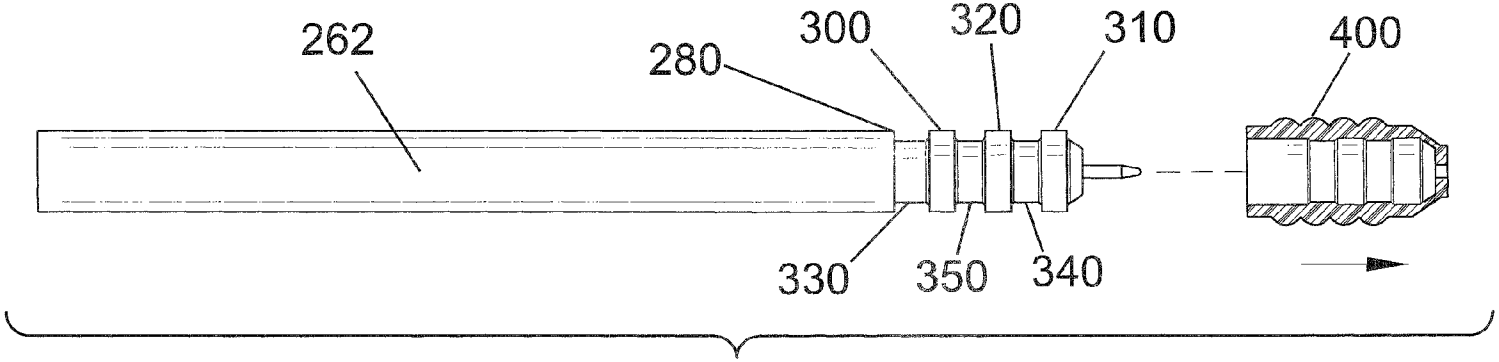
FIG. 11 is a side view of an alternate embodiment of the present invention.
Figure 12:
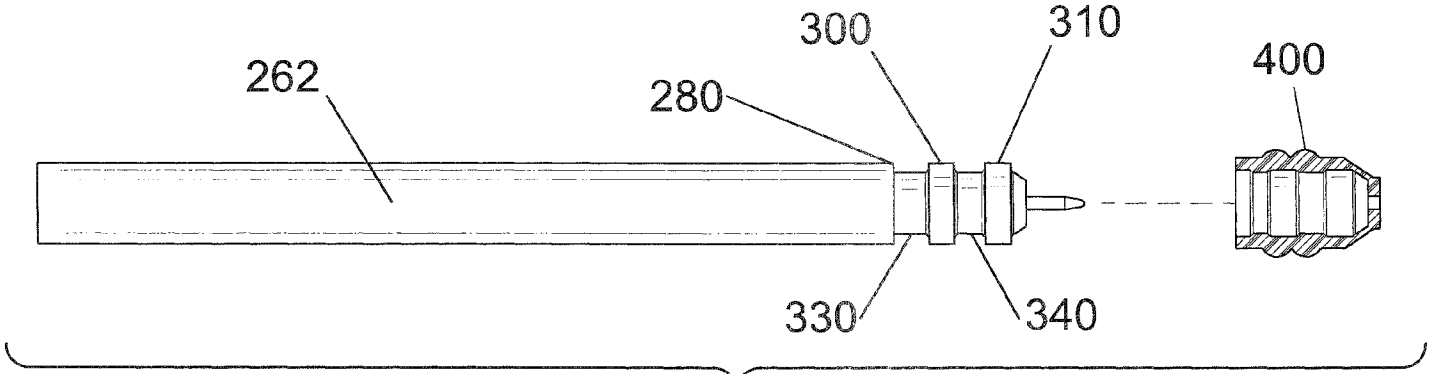
FIG. 12 is a side view of an alternate embodiment of the present invention.

Following is a list of elements corresponding to a particular element referred to herein:

100 Ball point pen system
200 Pen housing
210 Pen housing anterior end
220 Pen housing anterior aperture
230 Pen housing posterior end
240 Pen housing posterior aperture
250 Pen housing cavity
260 Pen housing first exterior diameter
262 Pen housing exterior surface
270 Pen housing second exterior diameter
280 Pen housing shoulder
300 Posterior external annular ridge
310 Anterior external annular ridge
320 Median external annular ridge
330 Posterior external annular groove
332 Posterior external annular groove first end
334 Posterior external annular groove second end
340 Anterior external annular groove
342 Anterior external annular groove first end
344 Anterior external annular groove second end
350 Median external annular groove
352 Median external annular groove first end
354 Median external annular groove second end
400 Top cap
410 Top cap anterior end
412 Top cap tapered tip
420 Top cap anterior end aperture
430 Top cap posterior end
440 Top cap posterior end aperture
450 Top cap channel
460 Top cap interior diameter
470 Top cap exterior surface
480 Top cap anterior internal annular ridge
490 Top cap posterior internal annular ridge
500 Ballpoint ink cartridge
510 Cartridge anterior end
520 Cartridge posterior end
530 Ballpoint tip
600 External threads
610 Internal threads
620 Ribs Referring now to FIG. 1-12, the present invention features a ballpoint pen system (100) comprising a pen housing (200) having a pen housing anterior end (210), a pen housing posterior end (230), and a pen housing cavity (250) located inside. In some embodiments, the pen housing cavity (250) is fluidly connected to a pen housing anterior aperture (220) located on the pen housing anterior end (210). In some embodiments, the pen housing (200) comprises a pen housing first exterior diameter (260). In some embodiments, the pen housing (200) comprises a pen housing second exterior diameter (270), located closely to the pen housing anterior end (210). In some embodiments, the pen housing second exterior diameter (270) is smaller than the pen housing first exterior diameter (260). In some embodiments, a pen housing shoulder (280) is located between the pen housing second exterior diameter (270) and the pen housing first exterior diameter (260).

In some embodiments, the pen housing (200) comprises a posterior external annular ridge (300) located on a cross-section of a transverse plane of the pen housing second exterior diameter (270) closely to the pen housing shoulder (280). In some embodiments, the pen housing (200) comprises an anterior external annular ridge (310) located on a cross-section of a transverse plane of the pen housing second exterior diameter (270) closely to the pen housing anterior end (210). In some embodiments, the pen housing (200) comprises a median external annular ridge (320) located on a cross-section of a transverse plane of the pen housing second exterior diameter (270) between the posterior external annular ridge (300) and the anterior external annular ridge (310).

In some embodiments a posterior external annular groove (330) is located on a cross-section of a transverse plane of the pen housing second exterior diameter (270) having a posterior external annular groove first end (332) defined by the pen housing shoulder (280) and a posterior external annular groove second end (334) defined by a proximal end of the posterior external annular ridge (300). In some embodiments, the posterior external annular groove (330) comprises the pen housing second exterior diameter (270).

In some embodiments, an anterior external annular groove (340) is located on a cross-section of a transverse plane of the pen housing second exterior diameter (270) having an anterior external annular groove first end (342) defined by a proximal end of the median external annular ridge (320) and an anterior external annular groove second end (344) defined by a proximal end of the anterior external annular ridge (310). In some embodiments, the anterior external annular groove (340) comprises the pen housing second exterior diameter (270).

In some embodiments, a median external annular groove (350) is located on a cross-section of a transverse plane of the pen housing second exterior diameter (270) having a median external annular groove first end (352) defined by a proximal end of the posterior external annular ridge (300) and a median external annular groove second end (354) defined by a proximal end of the median external annular ridge (320). In some embodiments, the median external annular groove (350) comprises the pen housing second exterior diameter (270).

In some embodiments, the system (100) comprises a top cap (400) having a top cap anterior end (410) with a top cap anterior end aperture (420) located on a top cap tapered tip (412), a top cap posterior end (430) with a top cap posterior end aperture (440) located thereon, and a top cap channel (450) located therein fluidly connecting the top cap anterior end aperture (420) to the top cap posterior end aperture (440). In some embodiments, the top cap anterior end aperture (420) is sized to only allow the ballpoint tip (530) of the ballpoint ink cartridge (500) to slidably pass through.

In some embodiments, the top cap channel (450) comprises a top cap interior diameter (460) generally sized to snuggly and slidably interface with the pen housing second exterior diameter (270). In some embodiments, the top cap (400) comprises a top cap anterior internal annular ridge (480) located on a cross-section of a transverse plane of the top cap interior diameter (460) closely to the top cap anterior end (410). In some embodiments, the top cap (400) comprises a top cap posterior internal annular ridge (490) located on a cross-section of a transverse plane of the top cap interior diameter (460) closely to the top cap posterior end (430).

In some embodiments, the system (100) comprises a ballpoint ink cartridge (500) having a cartridge anterior end (510) and a cartridge posterior end (520). In some embodiments, the cartridge anterior end (510) comprises a ballpoint tip (530). In some embodiments, the ballpoint ink cartridge (500) is located in the pen housing (200). In some embodiments, the ballpoint tip (530) projects from and away from the pen housing anterior aperture (220).

In some embodiments, the top cap (400) is located on the pen housing anterior end (210). In some embodiments, in a first closed position the top cap anterior internal annular ridge (480) and the top cap posterior internal annular ridge (490) snuggly and slidably interface with the anterior external annular groove (340) and the median external annular groove (350), respectively. In some embodiments, in a second, open position, the top cap anterior internal annular ridge (480) and the top cap posterior internal annular ridge (490) snuggly and slidably interface with the median external annular groove (350) and the posterior external annular groove (330), respectively.

In some embodiments, in a first position, the ballpoint tip (530) is located below the top cap anterior end aperture (420). In some embodiments, in a second position, upon movement of the top cap (400) in a downward manner toward the pen housing posterior end (230), the ballpoint tip (530) is located above and through the top cap anterior end aperture (420). In some embodiments, the top cap anterior end aperture (420) is sized to only allow the ballpoint tip (530) of the ballpoint ink cartridge (500) to slidably pass through.

In some embodiments, the pen housing second exterior diameter comprises external threads (600). In some embodiments, the top cap interior diameter (460) comprises internal threads (610). In some embodiments, the top cap (400) attaches to the pen housing (200) via mated internal threads (610) and external threads (600).

In some embodiments, the top cap (400) comprises external ribs (620) located longitudinally on a top cap exterior surface (470). In some embodiments, the top cap (400) comprises external ribs (620) located annularly on a top cap exterior surface (470).

In some embodiments, when the top cap (400) is moved from a first position to a second position or from a second position to a first position, the distance between the first position of the top cap (400) and the second position of the top cap (400) is about ¼" of an inch. In some embodiments, when the top cap (400) is moved from a first position to a second position or from a second position to a first position, the distance between the first position of the top cap (400) and the second position of the top cap (400) is about ⅜" of an inch. In some embodiments, when the top cap (400) is moved from a first position to a second position or from a second position to a first position, the distance between the first position of the top cap (400) and the second position of the top cap (400) is about ½" of an inch. In some embodiments, when the top cap (400) is moved from a first position to a second position or from a second position to a first position, the distance between the first position of the top cap (400) and the second position of the top cap (400) is greater than about ½" of an inch.

In some embodiments, a ballpoint pen system (100) comprises a pen housing (200) having a pen housing anterior end (210), a pen housing posterior end (230), and a pen housing cavity (250) located therein. In some embodiments, the pen housing cavity (250) is fluidly connected to a pen housing anterior aperture (220) located on the pen housing anterior end (210). In some embodiments, the pen housing (200) comprises a pen housing first exterior diameter (260). In some embodiments, the pen housing (200) comprises a pen housing second exterior diameter (270), located closely to the pen housing anterior end (210). In some embodiments, the pen housing second exterior diameter (270) is smaller than the pen housing first exterior diameter (260). In some embodiments, a pen housing shoulder (280) is located between the pen housing second exterior diameter (270) and the pen housing first exterior diameter (260).

In some embodiments, the pen housing (200) comprises a posterior external annular ridge (300) located on a cross-section of a transverse plane of the pen housing second exterior diameter (270) closely to the pen housing shoulder (280).

In some embodiments, the pen housing (200) comprises an anterior external annular ridge (310) located on a cross-section of a transverse plane of the pen housing second exterior diameter (270) closely to the pen housing anterior end (210). In some embodiments, a posterior external annular groove (330) is located on a cross-section of a transverse plane of the pen housing second exterior diameter (270) having a posterior external annular groove first end (332) defined by the pen housing shoulder (280) and a posterior external annular groove second end (334) defined by a proximal end of the posterior external annular ridge (300). In some embodiments, the posterior external annular groove (330) comprises the pen housing second exterior diameter (270). In some embodiments, an anterior external annular groove (340) is located on a cross-section of a transverse plane of the pen housing second exterior diameter (270) having an anterior external annular groove first end (342) defined by a proximal end of the anterior external annular ridge (310) and an anterior external annular groove second end (344) defined by a proximal end of the posterior external annular ridge (300). In some embodiments, the anterior external annular groove (340) comprises the pen housing second exterior diameter (270).

In some embodiments, the system (100) comprises a top cap (400) having a top cap anterior end (410) with a top cap anterior end aperture (420) located on a top cap tapered tip (412), a top cap posterior end (430) with a top cap posterior end aperture (440) located thereon, and a top cap channel (450) located therein fluidly connecting the top cap anterior end aperture. (420) to the top cap posterior end aperture (440). In some embodiments, the top cap anterior end aperture (420) is sized to only allow the ballpoint tip (530) of the ballpoint ink cartridge (500) to slidably pass through.

In some embodiments, the top cap channel (450) comprises a top cap interior diameter (460) generally sized to snuggly and slidably interface with the pen housing second exterior diameter (270). In some embodiments, the top cap (400) comprises a top cap anterior internal annular ridge (480) located on a cross-section of a transverse plane of the top cap interior diameter (460) closely to the top cap anterior end (410). In some embodiments, the top cap (400) comprises, a top cap posterior internal annular ridge (490) located on a cross-section of a transverse plane of the top cap interior diameter (460) closely to the top cap posterior end (430).

In some embodiments, the system (100) comprises a ballpoint ink cartridge (500) having a cartridge anterior end (510) and a cartridge posterior end (520). In some embodiments, the cartridge anterior end (510) comprises a ballpoint tip (530). In some embodiments, the ballpoint ink cartridge (500) is located in the pen housing (200). In some embodiments, the ballpoint tip (530) projects from and away from the pen housing anterior aperture (220).

In some embodiments, the top cap (400) is located on the pen housing anterior end (210). In some embodiments, in a first closed position the top cap posterior internal annular ridge (490) snuggly and slidably interface with the anterior external annular groove (340). In some embodiments, in a second, open position, the top cap anterior internal annular ridge (480) and the top cap posterior internal annular ridge (490) snuggly and slidably interface with the anterior external annular groove (340) and the posterior external annular groove (330), respectively.

In some embodiments, in a first position, the ballpoint tip (530) is located below the top cap anterior end aperture (420). In some embodiments, in a second position, upon movement of the top cap (400) in a downward manner toward the pen housing posterior end (230), the ballpoint tip (530) is located above and through the top cap anterior end aperture (420). In some embodiments, the top cap anterior end aperture (420) is sized to only allow the ballpoint tip (530) of the ballpoint ink cartridge (500) to slidably pass through.

In some embodiments, the pen housing second exterior diameter comprises external threads (600). In some embodiments, the top cap interior diameter (460) comprises internal threads (610). In some embodiments, the top cap (400) attaches to the pen housing (200) via mated internal threads (610) and external threads (600).

In some embodiments, the top cap (400) comprises external ribs (620) located longitudinally on a top cap exterior surface (470). In some embodiments, the top cap (400) comprises external ribs (620) located annularly on a top cap exterior surface (470).

In some embodiments, when the top cap (400) is moved from a first position to a second position or from a second position to a first position, the distance between the first position of the top cap (400) and the second position of the top cap (400) is about ¼" of an inch. In some embodiments, when the top cap (400) is moved from a first position to a second position or from a second position to a first position, the distance between the first position of the top cap (400) and the second position of the top cap (400) is about ⅜" of an inch. In some embodiments, when the top cap (400) is moved from a first position to a second position or from a second position to a first position, the distance between the first position of the top cap (400) and the second position of the top cap (400) is about ½" of an inch. In some embodiments, when the top cap (400) is moved from a first position to a second position or from a second position to a first position, the distance between the first position of the top cap (400) and the second position of the top cap (400) is greater than about ½" of an inch.

In some embodiments, a ballpoint pen system (100) comprises a pen housing (200) comprising a general form of a prism, having a pen housing anterior end (210), a pen housing posterior end (230), and a pen housing cavity (250) located therein. In some embodiments, the pen housing cavity (250) is fluidly connected to a pen housing anterior aperture (220) located on the pen housing anterior end (210). In some embodiments, the pen housing (200) comprises a pen housing first exterior diameter (260). In some embodiments, the pen housing (200) comprises a pen housing second exterior diameter (270), located closely to the pen housing anterior end (210). In some embodiments, the pen housing second exterior diameter (270) is smaller than the pen housing first exterior diameter (260). In some embodiments, a pen housing shoulder (280) is located between the pen housing second exterior diameter (270) and the pen housing first exterior diameter (260).

In some embodiments, the pen housing (200) comprises a posterior external annular ridge (300) located on a cross-section of a transverse plane of the pen housing second exterior diameter (270) closely to the pen housing shoulder (280). In some embodiments, the pen housing (200) comprises an anterior external annular ridge (310) located on a cross-section of a transverse plane of the pen housing second exterior diameter (270) closely to the pen housing anterior end (210). In some embodiments, the pen housing (200) comprises a median external annular ridge (320) located on a cross-section of a transverse plane of the pen housing second exterior diameter (270) between the posterior external annular ridge (300) and the anterior external annular ridge (310).

In some embodiments, a posterior external annular groove (330) is located on a cross-section of a transverse plane of the pen housing second exterior diameter (270) having a posterior external annular groove first end (332) defined by the pen housing shoulder (280) and a posterior external annular groove second end (334) defined by a proximal end of the posterior external annular ridge (300). In some embodiments, the posterior external annular groove (330) comprises the pen housing second exterior diameter (270).

In some embodiments, an anterior external annular groove (340) is located on a cross-section of a transverse plane of the pen housing second exterior diameter (270) having an anterior external annular groove first end (342) defined by a proximal end of the median external annular ridge (320) and an anterior external annular groove second end (344) defined by a proximal end of the anterior external annular ridge (310). In some embodiments, the anterior external annular groove (340) comprises the pen housing second exterior diameter (270).

In some embodiments, a median external annular groove (350) is located on a cross-section of a transverse plane of the pen housing second exterior diameter (270) having a median external annular groove first end (352) defined by a proximal end of the posterior external annular ridge (300) and a median external annular groove second end (354) defined by a proximal end of the median external annular ridge (320). In some embodiments, the median external annular groove (350) comprises the pen housing second exterior diameter (270).

In some embodiments, the system (100) comprises a top cap (400) having a top cap anterior end (410) with a top cap anterior end aperture (420) located on a top cap tapered tip (412), a top cap posterior end (430) with a top cap posterior end aperture (440) located thereon, and a top cap channel (450) located therein fluidly connecting the top cap anterior end aperture (420) to the top cap posterior end aperture (440). In some embodiments, the top cap anterior end aperture (420) is sized to only allow the ballpoint tip (530) of the ballpoint ink cartridge (500) to slidably pass through.

In some embodiments, the top cap channel (450) comprises a top cap interior diameter (460) generally sized to snuggly and slidably interface with the pen housing second exterior diameter (270). In some embodiments, the top cap (400) comprises a top cap anterior internal annular ridge (480) located on a cross-section of a transverse plane of the top cap interior diameter (460) closely to the top cap anterior end (410). In some embodiments, the top cap (400) comprises a top cap posterior internal annular ridge (490) located on a cross-section of a transverse plane of the top cap interior diameter (460) closely to the top cap posterior end (430).

In some embodiments, the system (100) comprises a ballpoint ink cartridge (500) having a cartridge anterior end (510) and a cartridge posterior end (520). In some embodiments, the cartridge anterior end (510) comprises a ballpoint tip (530). In some embodiments, the ballpoint ink cartridge (500) is located in the pen housing (200). In some embodiments, the ballpoint tip (530) projects from and away from the pen housing anterior aperture (220).

In some embodiments, the top cap (400) is located on the pen housing anterior end (210). In some embodiments, in a first closed position the top cap anterior internal annular ridge (480) and the top cap posterior internal annular ridge (490) snuggly and slidably interface with the anterior external annular groove (340) and the median external annular groove (350), respectively. In some embodiments, in a second, open position, the top cap anterior internal annular ridge (480) and the top cap posterior internal annular ridge (490) snuggly and slidably interface with the median external annular groove (350) and the posterior external annular groove (330), respectively.

In some embodiments, in a first position, the ballpoint tip (530) is located below the top cap anterior end aperture (420). In some embodiments, in a second position, upon movement of the top cap (400) in a downward manner toward the pen housing posterior end (230), the ballpoint tip (530) is located above and through the top cap anterior end aperture (420). In some embodiments, the top cap anterior end aperture (420) is sized to only allow the ballpoint tip (530) of the ballpoint ink cartridge (500) to slidably pass through.

In some embodiments, the pen housing second exterior diameter comprises external threads (600). In some embodiments, the top cap interior diameter (460) comprises internal threads (610). In some embodiments, the top cap (400) attaches to the pen housing (200) via mated internal threads (610) and external threads (600).

In some embodiments, the top cap (400) comprises external ribs (620) located longitudinally on a top cap exterior surface (470). In some embodiments, the top cap (400) comprises external ribs (620) located annularly on a top cap exterior surface (470).

In some embodiments, when the top cap (400) is moved from a first position to a second position or from a second position to a first position, the distance between the first position of the top cap (400) and the second position of the top cap (400) is about ¼" of an inch. In some embodiments, when the top cap (400) is moved from a first position to a second position or from a second position to a first position, the distance between the first position of the top cap (400) and the second position of the top cap (400) is about ⅜" of an inch. In some embodiments, when the top cap (400) is moved from a first position to a second position or from a second position to a first position, the distance between the first position of the top cap (400) and the second position of the top cap (400) is about ½" of an inch. In some embodiments, when the top cap (400) is moved from a first position to a second position or from a second position to a first position, the distance between the first position of the top cap (400) and the second position of the top cap (400) is greater than about ½" of an inch.

In some embodiments, the prism is a rectangular prism. In some embodiments, the prism is a triangular prism.

In some embodiments, a ballpoint pen system (100) comprises a pen housing (200) having a pen housing anterior end (210), a pen housing posterior end (230), and a pen housing cavity (250) located therein. In some embodiments, the pen housing cavity (250) is fluidly connected to a pen housing anterior aperture (220) located on the pen housing anterior end (210). In some embodiments, the pen housing (200) comprises a pen housing exterior surface (262). In some embodiments, the pen housing (200) comprises a pen housing shoulder (280) located proximal to the pen housing anterior end (210) on the pen housing exterior surface (262). In some embodiments, the pen housing (200) comprises a posterior external annular ridge (300) located on a cross-section of a transverse plane of the pen housing exterior surface (262) proximal to the pen housing shoulder (280). In some embodiments, the pen housing (200) comprises an anterior external annular ridge (310) located on a cross-section of a transverse plane of the pen housing exterior surface (262) proximal to the pen housing anterior end (210). In some embodiments, the pen housing (200) comprises a median external annular ridge (320) located on a cross-section of a transverse plane of the pen housing exterior surface (262) between the posterior external annular ridge (300) and the anterior external annular ridge (310).

In some embodiments, a posterior external annular groove (330) is located on a cross-section of a transverse plane of the pen housing exterior surface (262) having a posterior external annular groove first end (332) defined by the pen housing shoulder (280) and a posterior external annular groove second end (334) defined by a proximal end of the posterior external annular ridge (300).

In some embodiments, an anterior external annular groove (340) is located on a cross-section of a transverse plane of the pen housing exterior surface (262) having an anterior external annular groove first end (342) defined by a proximal end of the median external annular ridge (320) and an anterior external annular groove second end (344) defined by a proximal end of the anterior external annular ridge (310).

In some embodiments, a median external annular groove (350) is located on a cross-section of a transverse plane of the, pen housing exterior surface (262) having a median external annular groove first end (352) defined by a proximal end of the posterior external annular ridge (300) and a median external annular groove second end (354) defined by a proximal end of the median external annular ridge (320).

In some embodiments, the system (100) comprises a top cap (400) having a top cap anterior end (410) with a top cap anterior end aperture (420) located on a top cap tapered tip (412), a top cap posterior end (430) with a top cap posterior end aperture (440) located thereon, and a top cap channel (450) located therein fluidly connecting the top cap anterior end aperture (420) to the top cap posterior end aperture (440). In some embodiments, the top cap anterior end aperture (420) is sized to only allow a ballpoint tip (530) of a ballpoint ink cartridge (500) to slidably pass through In some embodiments, the top cap channel (450) comprises a top cap interior diameter (460) generally sized to snuggly and slidably interface with the pen housing exterior surface (262). In some embodiments, the top cap (400) comprises a top cap anterior internal annular ridge (480) located on a cross-section of a transverse plane of the top cap interior diameter (460) proximal to the top cap anterior end (410). In some embodiments, the top cap (400) comprises a top cap posterior internal annular ridge (490) located on a cross-section of a transverse plane of the top cap interior diameter (460) proximal to the top cap posterior end (430).

In some embodiments, the system (100) comprises a ballpoint ink cartridge (500) having a cartridge anterior end (510) and a cartridge posterior end (520). In some embodiments, the cartridge anterior end (510) comprises a ballpoint tip (530). In some embodiments, the ballpoint ink cartridge (500) is located in the pen housing (200). In some embodiments, the ballpoint tip (530) projects from and away from the pen housing anterior aperture (220).

In some embodiments, the top cap (400) is located on the pen housing anterior end (210). In some embodiments, in a first closed position the top cap anterior internal annular ridge (480) and the top cap posterior internal annular ridge (490) snuggly and slidably interface with the anterior external annular groove (340) and the median external annular groove (350), respectively. In some embodiments, in a second, open position, the top cap anterior internal annular ridge (480) and the top cap posterior internal annular ridge (490) snuggly and slidably interface with the median external annular groove (350) and the posterior external annular groove (330), respectively.

In some embodiments, in a first position; the ballpoint tip (530) is located below the top cap anterior end aperture (420). In some embodiments, in a second position, upon movement of the top cap (400) in a downward manner toward the pen housing posterior end (230), the ballpoint tip (530) is located above and through the top cap anterior end aperture (420).

In some embodiments, the pen housing exterior surface (262) comprises external threads (600). In some embodiments, the top cap interior diameter (460) comprises internal threads (610). In some embodiments, the top cap (400) attaches to the pen housing (200) via mated internal threads (610) and external threads (600).

In some embodiments, the top cap (400) comprises external ribs (620) located longitudinally on a top cap exterior surface (470).

In some embodiments, the top cap (400) comprises external ribs (620) located annularly on a top cap exterior surface (470).

In some embodiments, the pen housing first exterior diameter (260) comprises a top cap external diameter. In some embodiments, the pen housing first exterior diameter (260) comprises the pen housing second exterior diameter (270). In some embodiments, the pen housing first exterior diameter (260) comprises the top cap interior diameter (460).

As used herein, the term "about" refers to plus or minus 10% of the referenced number. For example, an embodiment wherein the pen housing is about 10 inches in length includes a pen housing that is between 9 and 11 inches in length.

The disclosures of the following U.S. patents are incorporated in their entirety by reference herein: U.S. Pat. Nos. 4,679,954; 6,830,402.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A ballpoint pen system (100), wherein said system (100) comprises:

(a) a pen housing (200) having a pen housing anterior end (210), a pen housing posterior end (230), and a pen housing cavity (250) disposed therein, wherein the pen housing cavity (250) is fluidly connected to a pen housing anterior aperture (220) disposed on the pen housing anterior end (210), wherein the pen housing (200) further comprises:

(i) a pen housing first exterior diameter (260), (ii) a pen housing second exterior diameter (270), disposed proximal to the pen housing anterior end (210), wherein the pen housing second exterior diameter (270) is smaller than the pen housing first exterior diameter (260), wherein a pen housing shoulder (280) is disposed between the pen housing second exterior diameter (270) and the pen housing first exterior diameter (260), (iii) a posterior external annular ridge (300) disposed on a cross-section of a transverse plane of the pen housing second exterior diameter (270) proximal to the pen housing shoulder (280), (iv) an anterior external annular ridge (310) disposed on a cross-section of a transverse plane of the pen housing second exterior diameter (270) proximal to the pen housing anterior end (210), and (v) a median external annular ridge (320) disposed on a cross-section of a transverse plane of the pen housing second exterior diameter (270) between the posterior external annular ridge (300) and the anterior external annular ridge (310), wherein a posterior external annular groove (330) is disposed on a cross-section of a transverse plane of the pen housing second exterior diameter (270) having a posterior external annular groove first end (332) defined by the pen housing shoulder (280) and a posterior external annular groove second end (334) defined by a proximal end of the posterior external annular ridge (300), wherein the posterior external annular groove (330) comprises the pen housing second exterior diameter (270), wherein an anterior external annular groove (340) is disposed on a cross-section of a transverse plane of the pen housing second exterior diameter (270) having an anterior external annular groove first end (342) defined by a proximal end of the median external annular ridge (320) and an anterior external annular groove second end (344) defined by a proximal end of the anterior external annular ridge (310), wherein the anterior external annular groove (340) comprises the pen housing second exterior diameter (270), wherein a median external annular groove (350) is disposed on a cross-section of a transverse plane of the pen housing second exterior diameter (270) having a median external annular groove first end (352) defined by a proximal end of the posterior external annular ridge (300) and a median external annular groove second end (354) defined by a proximal end of the median external annular ridge (320), wherein the median external annular groove (350) comprises the pen housing second exterior diameter (270);

(b) a top cap (400) having a top cap anterior end (410) with a top cap anterior end aperture (420) disposed on a top cap tapered tip (412), a top cap posterior end (430) with a top cap posterior end aperture (440) disposed thereon, and a top cap channel (450) disposed therein fluidly connecting the top cap anterior end aperture (420) to the top cap posterior end aperture (440), wherein the top cap anterior end aperture (420) is sized to only allow a ballpoint tip (530) of a ballpoint ink cartridge (500) to slidably pass through, wherein the top cap channel (450) comprises a top cap interior diameter (460) generally sized to snuggly and slidably interface with the pen housing second exterior diameter (270), wherein the top cap (400) further comprises:

(i) a top cap anterior internal annular ridge (480) disposed on a cross-section of a transverse plane of the top cap interior diameter (460) proximal to the top cap anterior end (410), and (ii) a top cap posterior internal annular ridge (490) disposed on a cross-section of a transverse plane of the top cap interior diameter (460) proximal to the top cap posterior end (430); and (c) a ballpoint ink cartridge (500) having a cartridge anterior end (510) and a cartridge posterior end (520), wherein the cartridge anterior end (510) comprises a ballpoint tip (530), wherein the ballpoint ink cartridge (500) is disposed in the pen housing (200), wherein the ballpoint tip (530) projects from and away from the pen housing anterior aperture (220);

wherein the top cap (400) is disposed on the pen housing anterior end (210), wherein in a first closed position the top cap anterior internal annular ridge (480) and the top cap posterior internal annular ridge (490) snuggly and slidably interface with the anterior external annular groove (340) and the median external annular groove (350), respectively, wherein in a second, open position, the top cap anterior internal annular ridge (480) and the top cap posterior internal annular ridge (490) snuggly and slidably interface with the median external annular groove (350) and the posterior external annular groove (330), respectively;

wherein in either a first position or a second position, an entire internal surface of the top cap (400) interfaces with an external surface of the pen housing (200) with no gap;

wherein in a first position, the ballpoint tip (530) is disposed below the top cap anterior end aperture (420), wherein in a second position, upon movement of the top cap (400) in a downward manner toward the pen housing posterior end (230), the ballpoint tip (530) is disposed above and through the top cap anterior end aperture (420).

2. The system (100) of claim 1, wherein the top cap (400) comprises external ribs (620) disposed longitudinally on a top cap exterior surface (470).

3. The system (100) of claim 1, wherein the top cap (400) comprises external ribs (620) disposed annularly on a top cap exterior surface (470).

4. A ballpoint pen system (100), wherein said system (100) consists of:

(a) a pen housing (200) consisting of a pen housing anterior end (210), a pen housing posterior end (230), and a pen housing cavity (250) disposed therein, wherein the pen housing cavity (250) is fluidly connected to a pen housing anterior aperture (220) disposed on the pen housing anterior end (210), wherein the pen housing (200) further consists of:

(i) a pen housing first exterior diameter (260), (ii) a pen housing second exterior diameter (270), disposed proximal to the pen housing anterior end (210), wherein the pen housing second exterior diameter (270) is smaller than the pen housing first exterior diameter (260), wherein a pen housing shoulder (280) is disposed between the pen housing second exterior diameter (270) and the pen housing first exterior diameter (260), (iii) a posterior external annular ridge (300) disposed on a cross-section of a transverse plane of the pen housing second exterior diameter (270) proximal to the pen housing shoulder (280), (iv) an anterior external annular ridge (310) disposed on a cross-section of a transverse plane of the pen housing second exterior diameter (270) proximal to the pen housing anterior end (210), and (v) a median external annular ridge (320) disposed on a cross-section of a transverse plane of the pen housing second exterior diameter (270) between the posterior external annular ridge (300) and the anterior external annular ridge(310), wherein a posterior external annular groove (330) is disposed on a cross-section of a transverse plane of the pen housing second exterior diameter (270) consisting of a posterior external annular groove first end (332) defined by the pen housing shoulder (280) and a posterior external annular groove second end (334) defined by a proximal end of the posterior external annular ridge (300), wherein the posterior external annular groove (330) comprises the pen housing second exterior diameter (270), wherein an anterior external annular groove (340) is disposed on a cross-section of a transverse plane of the pen housing second exterior diameter (270) consisting of an anterior external annular groove first end (342) defined by a proximal end of the median external annular ridge (320) and an anterior external annular groove second end (344) defined by a proximal end of the anterior external annular ridge (310), wherein the anterior external annular groove (340) consists of the pen housing second exterior diameter (270), wherein a median external annular groove (350) is disposed on a cross-section of a transverse plane of the pen housing second exterior diameter (270) consisting of a median external annular groove first end (352) defined by a proximal end of the posterior external annular ridge (300) and a median external annular groove second end (354) defined by a proximal end of the median external annular ridge (320), wherein the median external annular groove (350) consists of the pen housing second exterior diameter (270);

(b) a top cap (400) consisting of a top cap anterior end (410) with a top cap anterior end aperture (420) disposed on a top cap tapered tip (412), a top cap posterior end (430) with a top cap posterior end aperture (440) disposed thereon, and a top cap channel (450) disposed therein fluidly connecting the top cap anterior end aperture (420) to the top cap posterior end aperture (440), wherein the top cap anterior end aperture (420) is sized to only allow a ballpoint tip (530) of a ballpoint ink cartridge (500) to slidably pass through, wherein the top cap channel (450) comprises a top cap interior diameter (460) generally sized to snuggly and slidably interface with the pen housing second exterior diameter (270), wherein the top cap (400) further consists of:

(i) a top cap anterior internal annular ridge (480) disposed on a cross-section of a transverse plane of the top cap interior diameter (460) proximal to the top cap anterior end (410), and (ii) a top cap posterior internal annular ridge (490) disposed on a cross-section of a transverse plane of the top cap interior diameter (460) proximal to the top cap posterior end (430); and (c) a ballpoint ink cartridge (500) consisting of a cartridge anterior end (510) and a cartridge posterior end (520), wherein the cartridge anterior end (510) consists of a ballpoint tip (530), wherein the ballpoint ink cartridge (500) is disposed in the pen housing (200), wherein the ballpoint tip (530) projects from and away from the pen housing anterior aperture (220);

wherein the top cap (400) is disposed on the pen housing anterior end (210), wherein in a first closed position the top cap anterior internal annular ridge (480) and the top cap posterior internal annular ridge (490) snuggly and slidably interface with the anterior external annular groove (340) and the median external annular groove (350), respectively, wherein in a second, open position, the top cap anterior internal annular ridge (480) and the top cap posterior internal annular ridge (490) snuggly and slidably interface with the median external annular groove (350) and the posterior external annular groove (330), respectively;

wherein in either a first position or a second position, an entire internal surface of the top cap (400) interfaces with an external surface of the pen housing (200) with no gap;

wherein in a first position, the ballpoint tip (530) is disposed below the top cap anterior end aperture (420), wherein in a second position, upon movement of the top cap (400) in a downward manner toward the pen housing posterior end (230), the ballpoint tip (530) is disposed above and through the top cap anterior end aperture (420).

* * * * *